United States Patent [19]

Nowak et al.

[11] Patent Number: 4,822,051

[45] Date of Patent: Apr. 18, 1989

[54] PICTURE PUZZLE OF MULTIPLE PANELS WITH PROGRESSIVE DIFFICULTY

[75] Inventors: Ralph M. Nowak, Marblehead, Mass.; Harold Ashton, Providence, R.I.; Earlene Hornbostel, Brighton, Mass.

[73] Assignee: Kiddie Products, Inc., Avon, Mass.

[21] Appl. No.: 174,193

[22] Filed: Mar. 28, 1988

[51] Int. Cl.[4] ..... A63F 9/10

[52] U.S. Cl. ..... 273/157 R

[58] Field of Search ..... 273/157 R, 156; 434/205, 259

[56] References Cited

U.S. PATENT DOCUMENTS

| | | | |
|---|---|---|---|
| D. 73,964 | 5/1984 | Roth | 273/157 R X |
| 1,642,236 | 9/1927 | Foster . | |
| 1,676,641 | 7/1928 | Eschenbach | 273/157 R |
| 1,972,206 | 9/1934 | Thomay | 273/157 R |
| 2,738,594 | 3/1956 | Swingle . | |
| 3,280,499 | 10/1966 | Studen . | |
| 3,570,144 | 3/1971 | McNutt | 273/157 R |
| 4,219,194 | 8/1980 | Powers | 273/157 R |
| 4,259,804 | 4/1981 | Samuels | 273/157 R X |
| 4,478,583 | 10/1984 | Sellers | 273/157 R |

FOREIGN PATENT DOCUMENTS

| | | | |
|---|---|---|---|
| 2139303 | 2/1973 | Fed. Rep. of Germany | 273/157 R |
| 2395051 | 6/1977 | France | 273/157 R |
| 8001990 | 10/1980 | PCT Int'l Appl. | 273/157 R |

*Primary Examiner*—Anton O. Oechsle

[57] ABSTRACT

A child's puzzle toy has several discrete puzzle panels of progressively increasing difficulty. Each panel bears, on a first surface, a segment of a picture. The panels are assembled for joining the segments into continuous pictures. Each panel has at least one cavity and the puzzle further includes a corresponding puzzle piece of size and shape to be received snugly into the cavity.

10 Claims, 2 Drawing Sheets

PICTURE PUZZLE OF MULTIPLE PANELS WITH PROGRESSIVE DIFFICULTY

The invention relates to picture puzzles consisting of two or more panels with puzzle pieces that fit into one or more puzzle cavities in each of the panels.

SUMMARY OF THE INVENTION

According to the invention, a child's toy in the form of a puzzle comprises a plurality of discrete puzzle panels, each puzzle panel bearing, on a first surface, a segment of a pictorial representation, the puzzle panels adapted for assembly into a unit for joining the segments into a contiguous pictorial display, and each puzzle panel defining, in the first surface, at least one cavity of predetermined size and shape, and the puzzle further comprising a puzzle piece of corresponding size and shape sized and adapted to be received snugly into the cavity.

Preferred embodiments of this aspect of the invention may include one or more of the following features. A first puzzle panel defines a finite number X of cavities, and a predetermined number N of additional puzzle panels each define a finite number $Y_N$ of cavities, where $Y_N > X$. The puzzle comprising at least two additional puzzle panels, and the number of cavities $Y_1$ defined by a first additional puzzle panel is less than the number of cavities $Y_2$ defined by a second additional puzzle panel. The puzzle further comprises a third additional puzzle panel, and the number of cavities $Y_3$ defined by the third additional puzzle panel is greater than $Y_1$ and greater than $Y_2$. One or more of the puzzle pieces is of regular geometric shape. The puzzle panels define at least two cavities of common size and shape, and the puzzle comprises at least two puzzle pieces of corresponding size and shape and each of the two puzzle pieces is adapted to be received snugly into either of the cavities of common size and shape.

According the another aspect of the invention, a child's toy in the form of a puzzle comprises a first puzzle panel bearing on a first surface a pictorial segment and defining, in the first surface, a finite number $N_1$ of cavities, each of selected size and shape, and comprising $N_1$ puzzle pieces each corresponding in size and shape to a cavity of the first puzzle panel, and adapted to be received snuggly therein, a second puzzle panel bearing on a first surface a pictorial segment and defining, in the first surface, a finite number $N_2$ of cavities, each of selected size and shape, and $N_2$ puzzle pieces each corresponding in size and shape to a cavity of the second puzzle panel and adapted to be received snuggly therein, a third puzzle panel bearing on a first surface a pictorial segment and defining in the first surface, a finite number $N_3$ of cavities, each of selected size and shape, and $N_3$ puzzle pieces each corresponding in size and shape to a cavity of the third puzzle panel and adapted to be received snuggly therein, and $N_3 \geqq N_2 < N_1$.

Preferred embodiments of this aspect of the invention may include one or more of the following features. The puzzle further comprises a fourth puzzle panel bearing on a first surface a pictorial segment and defining, in the first surface, a finite number $N_4$ of cavities, each of selected size and shape, and $N_4$ puzzle pieces each corresponding in size and shape to a cavity of the fourth puzzle panel and adapted to be received snuggly therein, and $N_4 \geqq N_3$. The puzzle panels are adapted for random assembly into a contiguous pictorial display. Each puzzle panel comprises first assembly means disposed at a first edge of the puzzle panel, and second assembly means disposed at a second, opposite edge of the puzzle panel, the first and second assembly means of one puzzle panel adapted to interengage with respective second and first assembly means of adjacent puzzle panels. The first assembly means comprises an orifice defined by the puzzle panel, and the second assembly means comprises a protruding foot strip element sized and adapted to be received in an orifice for assembly of adjacent puzzle panels.

There is thus provided a child's puzzle of, e.g., four panels, each displaying a segment of a picture, the panels assemblable, in any sequence, to form a complete picture. The panels are of progressively increasing difficulty, i.e., the first panel has a finite member of puzzle pieces and each successive panel has a greater number of, or different, puzzle pieces and is, therefore, of greater difficulty than the preceding puzzle panels.

These and other features and advantages of the invention will be seen from the following description of a presently preferred embodiment, and from the claims.

PREFERRED EMBODIMENT

We first briefly describe the drawings.

Figure 1:
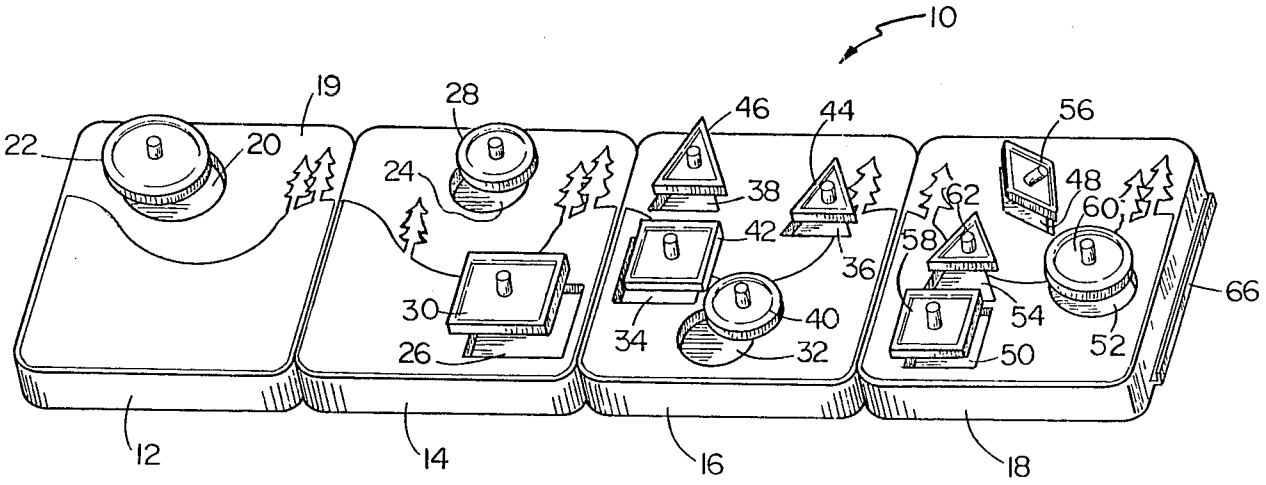
FIG. 1 is a perspective view of a multiple panel puzzle of the invention, assembled in a contiguous pictorial display.
Figure 4:
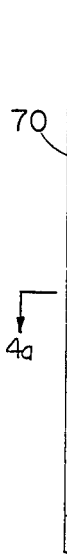
Figure 2:
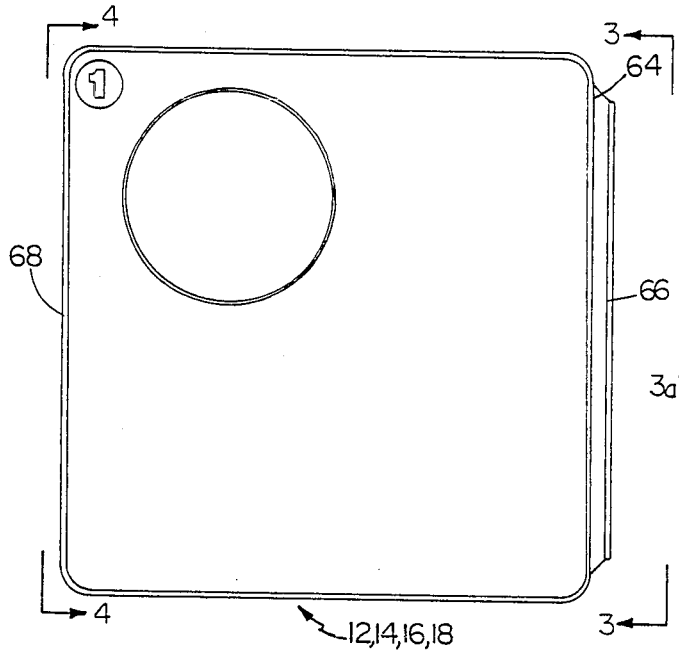
FIG. 2 is a plan view of a single puzzle panel.
Figure 3:
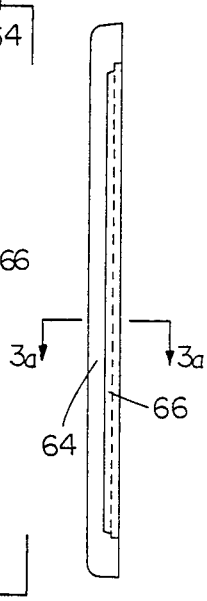
Figure 4A:
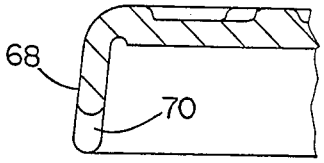
Figure 3A:
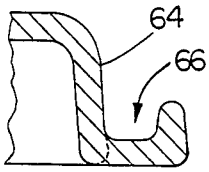
Figure 5:
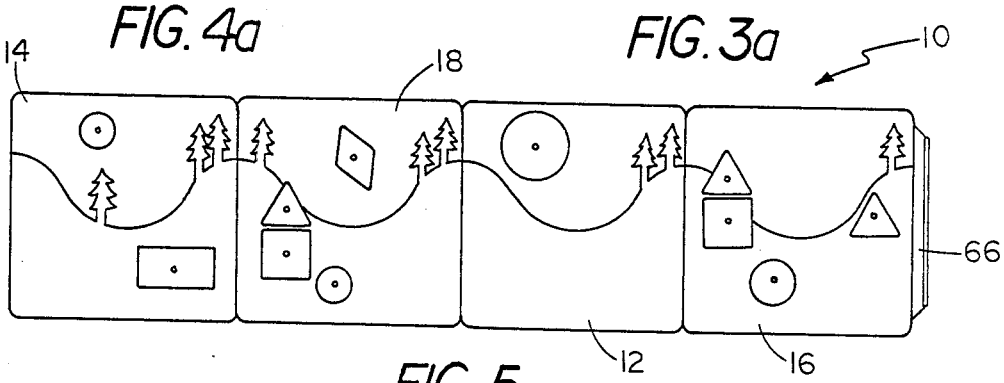
Figure 6:
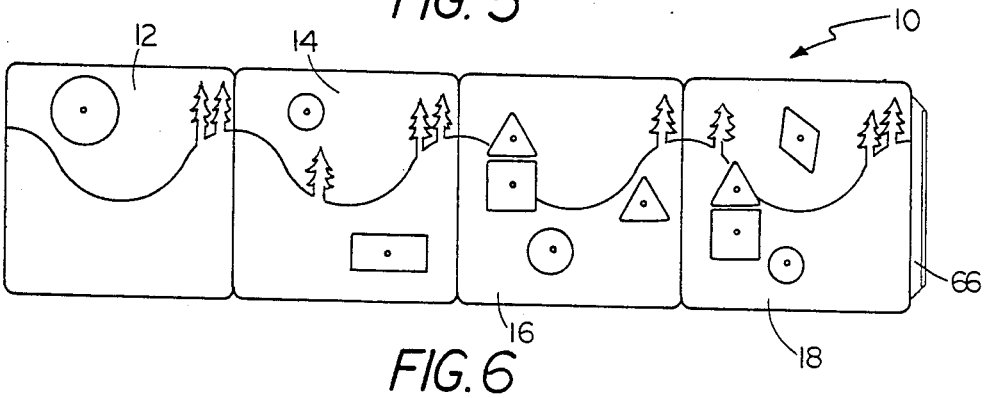

FIGS. 3 and 4 are side views of the puzzle panel of FIG. 2, taken at lines 3—3 and 4—4, while FIGS. 3*a* and 4*a* are side sectional views of the puzzle panel, taken at lines 3*a*—3*a* and 4*a*—4*a*, respectively, of FIGS. 3 and 4; and FIGS. 5 and 6 are somewhat diagrammatic views of the puzzle of FIG. 1 with panels arranged in other sequences to form different contiguous pictorial displays.

Referring to FIG. 1, a child's puzzle 10 consists of a plurality, e.g., four are shown, puzzle panels 12, 14, 16, 18. Each panel, or tray, bears, on a first surface 19, a segment of a pictorial representation, the panels, when assembled together, providing a contiguous pictorial display, as in FIG. 1.

Each puzzle panel defines, in the first surface, one or more cavities of a predetermined size and shape, e.g., a regular geometric shape such as a circle, triangle or square, and the panels further include a puzzle piece of size and shape to be received snuggly into the corresponding cavity. The number and complexity of the puzzle pieces associated with the respective puzzle panels are chosen so the panels are of progressively increasing difficulty, to allow a young child to advance in skill and dexterity.

Referring to FIG. 1, the first and most simple puzzle panel 12 has a single cavity 20 of large circular shape, within which may be disposed a large, circular puzzle piece 22. The next most simple puzzle panel 14 has two cavities, a circle 24 and a square 26, into which may be disposed puzzle pieces 28, 30 of corresponding size and shape. The next puzzle panel 16 is more difficult than the panels described above, and defines four cavities, a circle 32, a square 34 and two triangles 36, 38, into which are disposed respective puzzle pieces 40, 42, 44, 46 of corresponding configuration. The last puzzle panel 18, the most difficult, defines four cavities, including a kite-shape cavity 48 of relatively greater complexity than the cavities of the other panels. Also defined by the fourth panel are cavities in the shape of a square 50, a circle 52 and a triangle 54. Again, puzzle pieces 56, 58, 60 and 62 of corresponding size and shape are provided.

In the preferred embodiment, the puzzle panels and the puzzle pieces are formed of high impact polystyrene (HIPS) by injection molding. The puzzle pieces are of different colors, and preferably are interchangeable (with exception of the large circle piece 22 and the kite-shape piece 56) between panels with puzzle pieces of consisting size and shape, e.g., circle pieces 28, 40 and 60 are interchangeable, as are square pieces 30, 42, 54 and triangle pieces 46, 44, 62.

Referring to FIG. 2, each puzzle panel defines, at a first edge surface 64, a protruding foot strip 66 (FIGS. 3 and 3*a*) and, at a second, opposite edge surface 68, an orifice 70 (FIGS. 4 and 4*a*). The foot strip 66 is sized to be received in an orifice of an adjoining puzzle panel, and the orifice 70 is sized to engage upon a foot strip of an adjoining puzzle panel, for assembling the panels on a flat surface to join the picture segments of the respective puzzle panels into a contiguous pictorial display.

Referring to FIGS. 5 and 6, the panels may be assembled to provide a contiguous pictorial display of the segments in any sequence, e.g., twenty-four different arrangements are possible with the puzzle of FIG. 1.

Other embodiments are within the claims.

We claim:

1. A child's toy in the form of a puzzle comprising:

a plurality of discrete puzzle panels, each said puzzle panel bearing, on a first surface, a segment of a pictorial representation, said puzzle panels adapted for assembly into a unit for joining of said segments into a contiguous pictorial display, said puzzle panels being adapted for random assembly into said contiguous pictorial display, and each said puzzle panel defining, in said first surface, at least one cavity of predetermined size and shape, and said puzzle further comprising a puzzle piece of corresponding size and shape sized and adapted to be received snugly into said cavity.

2. The child's toy of claim 1 wherein a first said puzzle panel defines a finite number X of cavities, and a predetermined number N of additional puzzle panels each define a finite number $Y_N$ of cavities, where $Y_N > X$.

3. The child's toy of claim 2 comprising at least two said additional puzzle panels, and the number of cavities $Y_1$ defined by a first said additional puzzle panel is less than the number of cavities $Y_2$ defined by a second said additional puzzle panel.

4. The child's toy of claim 3 wherein said puzzle further comprises a third said additional puzzle panel, and the number of cavities $Y_3$ defined by the third said additional puzzle panel is greater than $Y_1$ and greater than $Y_2$.

5. The child's toy of claim 1 wherein one or more of said puzzle pieces is of regular geometric shape.

6. The child's toy of claim 1 wherein said puzzle panels define at least two said cavities of common size and shape, and said puzzle comprises at least two puzzle pieces of corresponding size and shape, and each of said two puzzle pieces being adapted to be received snugly into either of said cavities of common size and shape.

7. A child's toy in the form of a puzzle comprising:

a first puzzle panel bearing on a first surface a pictorial segment and defining, in said first surface, a finite number $N_1$ of cavities, each of selected size and shape, and comprising $N_1$ puzzle pieces each corresponding in size and shape to a cavity of said first puzzle panel, and adapted to be received snugly therein, a second puzzle panel bearing on a first surface a pictorial segment and defining, in said first surface, a finite number $N_2$ of cavities, each of selected size and shape, and $N_2$ puzzle pieces each corresponding in size and shape to a cavity of said second puzzle panel and adapted to be received snugly therein, a third puzzle panel bearing on a first surface a pictorial segment and defining in said first surface, and finite number $N_3$ of cavities, each of selected size and shape, and $N_3$ puzzle pieces each corresponding in size and shape to a cavity of said third puzzle panel and adapted to be received snugly therein, $N_3 \geqq N_2 \geqq N_1 \geqq$ and said first, second and third puzzle panels being adapted for random assembly into a contiguous pictorial display.

8. The child's toy of claim 7 further comprising:

a fourth puzzle panel bearing on a first surface a pictorial segment and defining, in said first surface, a finite number $N_4$ of cavities, each of selected size and shape, and $N_4$ puzzle pieces each corresponding in size and shape to a cavity of said fourth puzzle panel and adapted to be received snugly therein, $N_4 \geqq N_3$, and said fourth puzzle panel being adapted for random assembly with said first, second and third puzzle panels into a contiguous pictorial display.

9. The child's toy of claim 1 or 7 wherein each said puzzle panel comprises first assembly means disposed at a first edge of said puzzle panel, and second assembly means disposed at a second, opposite edge of said puzzle panel, said first assembly means and said second assembly means of one puzzle panel adapted to interengage with respective second assembly mean and first assembly means of adjacent puzzle panels.

10. The child's toy of claim 9 wherein said first assembly means comprises an orifice defined by said puzzle panel, and said second assembly means comprises a protruding foot strip element sized and adapted to be received in a said orifice for assembly of adjacent puzzle panels.

* * * * *